US006841935B2

(12) United States Patent
Kyushima et al.

(10) Patent No.: US 6,841,935 B2
(45) Date of Patent: Jan. 11, 2005

(54) ELECTRON-MULTIPLIER AND PHOTO-MULTIPLIER HAVING DYNODES WITH PARTITIONING PARTS

(75) Inventors: Hiroyuki Kyushima, Hamamatsu (JP); Akira Atsumi, Hamamatsu (JP); Hideki Shimoi, Hamamatsu (JP)

(73) Assignee: Hamamatsu Photonics, K. K., Hamamatsu (JP)

( * ) Notice: Subject to any disclaimer, the term of this patent is extended or adjusted under 35 U.S.C. 154(b) by 0 days.

(21) Appl. No.: 10/240,568

(22) PCT Filed: Apr. 3, 2001

(86) PCT No.: PCT/JP01/02896

§ 371 (c)(1),
(2), (4) Date: Oct. 3, 2002

(87) PCT Pub. No.: WO01/75933

PCT Pub. Date: Oct. 11, 2001

(65) Prior Publication Data

US 2003/0102802 A1 Jun. 5, 2003

(30) Foreign Application Priority Data

Apr. 3, 2000 (JP) ..... 2000-101099

(51) Int. Cl.[7] ..... H01J 43/04; H01J 43/10

(52) U.S. Cl. ..... 313/533; 313/103 CM; 250/207

(58) Field of Search ..... 313/103 CM, 103 R, 313/104, 105 R, 105 CM, 532, 533, 534, 535, 542; 250/207, 214 VT; 315/341

(56) References Cited

U.S. PATENT DOCUMENTS 3,229,143 A 1/1966 Bartschat
3,914,634 A 10/1975 Overall et al.
4,626,736 A 12/1986 Mansell
4,893,053 A * 1/1990 Knapp et al. ..... 313/400
5,510,674 A 4/1996 Kyushima et al.
5,801,511 A 9/1998 Kyushima et al.
6,384,519 B1 * 5/2002 Beetz et al. ..... 313/103 CM

FOREIGN PATENT DOCUMENTS

| | | |
|---|---|---|
| EP | 0 006 267 A1 | 1/1980 |
| EP | 0 911 866 A1 | 4/1999 |
| GB | 1 401 969 | 8/1975 |
| JP | A 11-329339 | 11/1999 |

* cited by examiner

*Primary Examiner*—Nimeshkumar D. Patel
*Assistant Examiner*—Karabi Guharay
(74) *Attorney, Agent, or Firm*—Oliff & Berridge, PLC

(57) ABSTRACT

A dynode (8) constituting an electron multiplier or a photomultiplier is provided with eight rows of channels (15) each defined by an outer frame (16) and a partitioning part (17) of the dynode (8). In each channel (15), a plurality of electron multiplying holes (14) are arranged. In specified positions of the outer frame (16) and the partitioning part (17) of the dynode (8), glass receiving parts (21) wider than the outer frame (16) and the partitioning part (17) are provided integrally with the dynode (8). Glass parts (22) are bonded to all the glass receiving parts (21). The glass parts (22) are bonded by applying glass to the glass receiving parts (21) and hardening the glass and each have a generally dome-like convex shape. Each dynode (8) is formed after the dome-like glass part (22) is bonded to the glass receiving part (21).

16 Claims, 10 Drawing Sheets

8
16
22
41
22
41
22
41

ELECTRON-MULTIPLIER AND PHOTO-MULTIPLIER HAVING DYNODES WITH PARTITIONING PARTS

TECHNICAL FIELD

The present invention relates to an electron multiplier and photomultiplier including an electron multiplying unit formed by a plurality of stacked dynodes. A photomultiplier is a vacuum tube including a light-receiving faceplate, a photocathode, an electron multiplying unit, and anodes that functions to detect light incident on the faceplate. The electron multiplier basically includes the electron multiplying unit and anodes of the photomultiplier and serves to detect ions, electrons, and the like incident on the first layer of the electron multiplying unit.

BACKGROUND ART

The electron multiplier and photomultiplier are well known in the art, as disclosed, for example, in Japanese published examined patent application No. SHO-56-1741. The photomultiplier disclosed in Japanese published examined patent application No. SHO-56-1741 includes a plurality of metal plates (dynodes) in which is formed a plurality of electron multiplying holes for multiplying electrons injected therein. A glass layer is formed across the surface of the output end or input end on the metal plates. The metal plates are stacked together with the glass layers interposed therebetween.

However, since a glass layer is formed across the entire output end or input end surface of the metal plates (dynodes) in the photomultiplier described above, warping can occur in the metal plate due to a difference in the thermal expansion coefficients of the metal plates and the glass layers, thereby making it difficult to stack the metal plates.

DISCLOSURE OF THE INVENTION

In view of the foregoing, it is an object of the present invention to provide an electron multiplier and photomultiplier in which dynodes can be easily stacked.

An electron multiplier according to the present invention includes an electron multiplying unit formed by stacking a plurality of dynodes wherein a plurality of electron multiplying holes is formed in each of the plurality of dynodes for multiplying electrons introduced therein. The electron multiplier is characterized in that glass parts, each formed in a dome shape, have a base portion bonded to the each of the plurality of dynodes at predetermined positions and that the plurality of dynodes are stacked together with the glass parts interposed between adjacent dynodes wherein dome shaped portions of the glass parts are locally in abutment with the adjacent dynode (8) without being bonded thereto.

In the electron multiplier according to the present invention, the glass parts formed in a dome shape are bonded to the dynodes at the predetermined positions. The dynodes are stacked together with the glass parts interposed between adjacent dynodes. Accordingly, the glass parts are bonded only to portions of the dynodes, decreasing the surface area of the bond between the dynodes and glass parts. As a result, it is possible to suppress warping in the dynodes, and the dynodes can be easily stacked together.

Further, partitioning parts are provided on the dynodes for partitioning the electron multiplying holes. It is desirable that the glass parts are bonded to the partitioning parts. By providing the partitioning parts on the dynodes for partitioning the electron multiplying holes and bonding the glass parts to the partitioning parts, the present invention can suppress a reduction in the surface area at areas in which the electron multiplying holes are formed, that is, the effective surface area for receiving light, while bonding the glass parts to the dynodes.

Further, partitioning parts are provided on the dynodes for partitioning the electron multiplying holes. Glass receiving parts formed wider than the partitioning parts are provided on parts of the partitioning parts. It is preferable that the glass parts are bonded to all of the glass receiving parts, serving as the predetermined positions. When providing glass receiving parts on which the glass parts are bonded, the surface area of the regions in which the electron multiplying holes are formed is reduced. However, by providing the glass receiving parts having a greater width than the partitioning parts on areas of the partitioning parts, as described above, it is possible to greatly suppress a reduction in the surface area of regions in which the electron multiplying holes are formed, that is, the effective surface area for receiving light. Further, by forming wide glass receiving parts, it is possible to bond glass parts of a greater height to the glass receiving parts, thereby ensuring a gap between each dynode and facilitating the operation for bonding the glass parts to the glass receiving parts.

Further, partitioning parts are provided on the dynodes for partitioning the electron multiplying holes. Each partitioning part has a predetermined width. Glass receiving parts formed wider than the partitioning parts are provided on parts of the partitioning parts. It is preferable that glass parts are bonded to only some of the glass receiving parts, serving as the predetermined positions. When providing glass receiving parts on which glass parts are bonded, the surface area of the parts in which the electron multiplying holes are formed is reduced. However, by providing the glass receiving parts with a wider width than the partitioning parts to portions of the partitioning parts, as described above, it is possible to greatly suppress a reduction in the surface area of regions in which the electron multiplying holes are formed, that is, the effective surface area for receiving light. Further, by forming wide glass receiving parts, it is possible to bond glass parts of a greater height to the glass receiving parts, thereby ensuring a gap between each dynode and facilitating the operation for bonding the glass parts to the glass receiving parts. In addition, by bonding the glass parts to only some of the glass receiving parts, the surface area of the bond between the dynodes and glass parts can be further reduced, thereby even more reliably suppressing warping in the dynodes.

Further, the glass receiving parts are provided on a portion of the areas in which the electron multiplying holes are formed in the dynodes. It is preferable that the glass parts are bonded to the glass receiving parts, serving as the predetermined positions. When the glass receiving parts are provided for bonding the glass parts, the surface area of the parts in which the electron multiplying holes are provided is reduced. However, as described above, by providing the glass receiving parts on a portion of the area in which the electron multiplying holes are formed in the dynodes, it is possible to suppress a reduction in the surface area of areas in which the electron multiplying holes are formed, that is the effective surface area for receiving light.

Further, it is desirable that the glass parts have a roughened surface. Surface creepage occurs in the glass parts when discharge originating at borders between the dynodes and glass parts is transferred to the stacked dynodes via the surface of the glass parts. By making the surface of the glass parts rough, as described above, the surface creepage distance on the glass parts is increased, suppressing discharge that occurs between the dynodes via the glass parts and reducing the noise generated by this discharge.

It is further desirable that the surface area of the bond between the glass part and the dynode is smaller than the area of the glass part projected onto the dynode. By making the bonded surface area between the glass part and the dynode smaller than the area of the glass part projected onto the dynode, the strength of the electric field between dynodes is reduced, increasing the breakdown voltage, thereby further suppressing the generation of discharge between dynodes via the glass parts and reliably reducing the generation of noise caused by this discharge.

The electron multiplier according to the present invention includes an electron multiplying unit formed by stacking a plurality of dynodes. A plurality of the glass parts is bonded to a first surface on one dynode of two adjacent dynodes within the plurality of layers. The other dynode in the pair of neighboring dynodes forms approximate point contacts with each of the plurality of glass parts.

By bonding the plurality of glass parts to the first surface of the dynodes in pairs of adjacent dynodes in the electron multiplier according to the present invention and stacking the other dynodes in the pairs of adjacent dynodes to form approximate point contacts with the glass parts, the surface area of the bonds between the glass parts and dynodes is reduced. As a result, it is possible to suppress warping in the dynodes and to facilitate the stacking of dynodes in layers.

The electron multiplier according to the present invention includes an electron multiplying unit formed by stacking a plurality of dynodes. A plurality of the glass parts is bonded to a first surface on one dynode of two adjacent dynodes within the plurality of layers. The other dynode in the pair of adjacent dynodes forms approximate line contacts with each of the plurality of glass parts.

By bonding the plurality of glass parts to the first surfaces of the dynodes in the pairs of neighboring dynodes in the electron multiplier according to the present invention and stacking the other dynodes in the pairs of adjacent dynodes to serve as approximate line contacts with the glass parts, the surface area of the bonds between the glass parts and dynodes is reduced. As a result, it is possible to suppress warping in the dynodes and to facilitate the stacking of dynodes in layers.

In addition, a photomultiplier is provided which includes the electron multiplier described in one of claims 1 through 9, and a photocathode.

In the photomultiplier according to the present invention, the surface area of the bonds between the dynodes and glass parts is reduced, thereby suppressing the occurrence of warping in the dynodes and facilitating the stacking of the dynodes in layers.

BEST MODE FOR CARRYING OUT THE INVENTION

Figure 1:
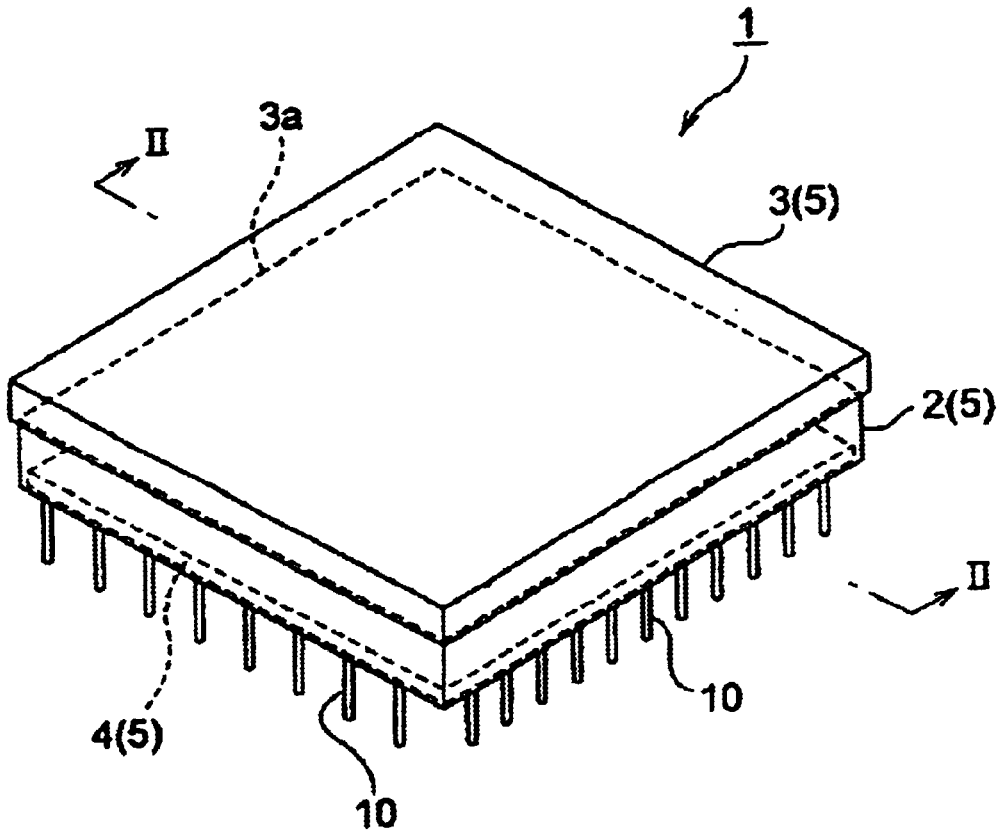
FIG. 1 is a perspective view showing a photomultiplier according to a preferred embodiment of the present invention.

An electron multiplier and photomultiplier according to a preferred embodiment of the present invention will be described in detail while referring to the accompanying drawings, wherein like parts and components are designated by the same reference numerals to avoid duplicating description. The preferred embodiment describes an example in which the present invention is applied to a photomultiplier used in a radiation detecting device.

Figure 2:
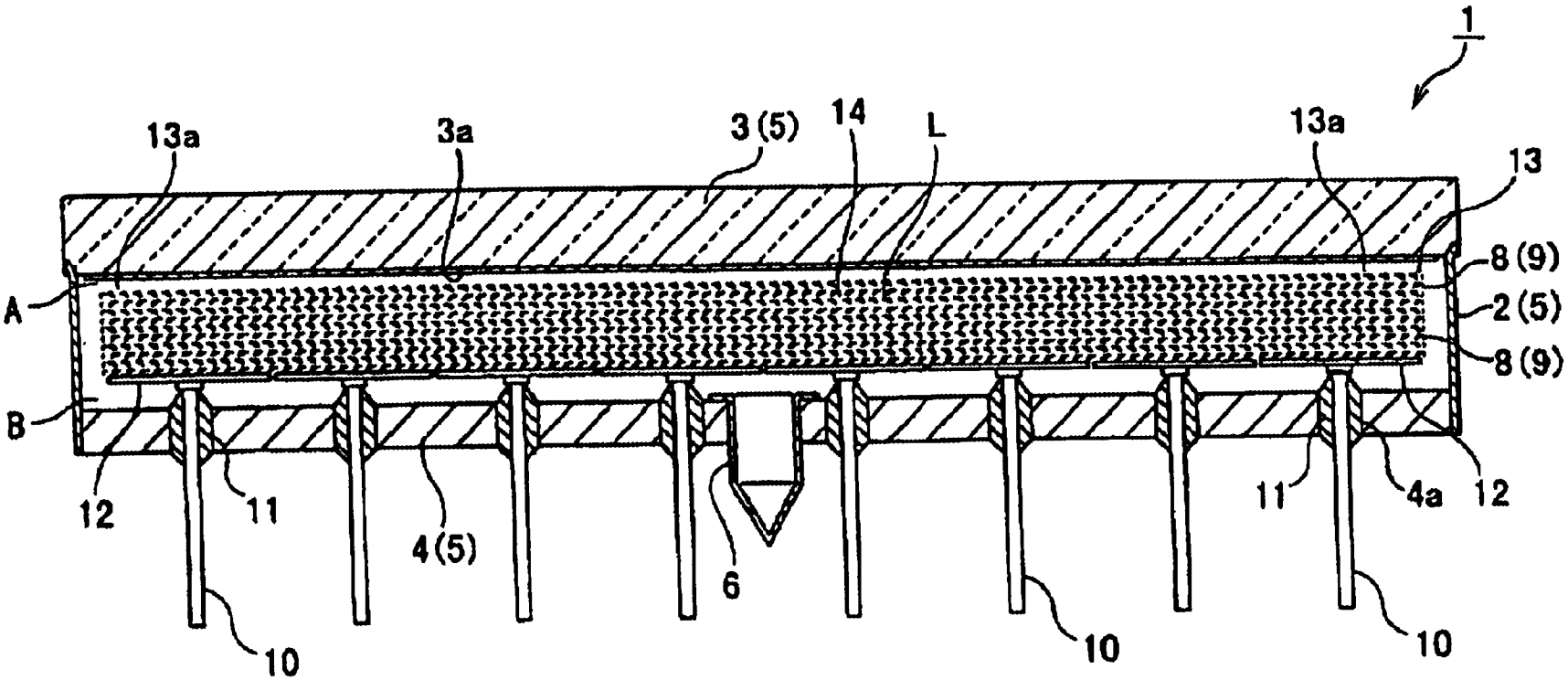
FIG. 2 is a cross-sectional view of the photomultiplier taken along the line II—II in FIG. 1.

FIG. 1 is a perspective view showing a photomultiplier according to a first embodiment of the present invention. FIG. 2 is a cross-sectional view of the photomultiplier taken along the line II—II in FIG. 1. A photomultiplier 1 shown in these drawings includes a side tube 2 shaped substantially like a rectangle and formed of a metal material (such as Kovar metal or stainless steel). A light receiving faceplate 3 formed of a glass material (such as Kovar glass or quartz glass) is fused to one open end A of the side tube 2. A photocathode 3*a* for converting light to electrons is formed on the inner surface of the faceplate 3. The photocathode 3*a* is formed by reacting an alkali metal with antimony that has been pre-deposited on the faceplate 3. a stem plate 4 formed of a metal material (such as Kovar metal or stainless steel) is welded to another open end B of the side tube 2. The assembly of the side tube 2, faceplate 3, and stem plate 4 form a hermetically sealed vessel 5. The vessel 5 is ultrathin and has a height of approximately 10 mm. It is to be noted that the faceplate 3 is not limited to a square shape, but can also have rectangular shape or a polygonal shape, such as a hexagon.

A metal evacuating tube 6 is fixed in the center of the stem plate 4. The evacuating tube 6 serves to evacuate the vessel 5 with a vacuum pump (not shown) after the photomultiplier tube 1 has been assembled to achieve a vacuum state in the vessel 5. The evacuating tube 6 is also used as a tube for introducing an alkali metal vapor into the vessel 5 when forming the photocathode 3*a*.

A stacked-type electron multiplying unit 9 having a block shape is disposed inside the vessel 5. The electron multiplying unit 9 is configured by stacking ten plate-shaped dynodes 8 (in ten layers). The electron multiplying unit 9 is supported in the vessel 5 by stem pins 10 formed of Kovar metal that penetrate the stem plate 4. The end of each stem pin 10 is electrically connected to each corresponding dynode 8. Pinholes 4*a* are formed in the stem plate 4, enabling the stem pins 10 to penetrate the stem plate 4. Each of the pinholes 4*a* is filled with a tablet 11 formed of Kovar glass and serving to form a hermetic seal between the stem pins 10 and the stem plate 4. Each stem pin 10 is fixed to the stem plate 4 via the tablet 11. The stem pins 10 are used for connecting not only to the dynodes but also to the anodes.

Anodes 12 are positioned below the electron multiplying section 9 and fixed to the top ends of the stem pins 10. A tabular focusing electrode plate 13 is disposed between the photocathode 3*a* and the electron multiplying section 9 in the top layer of the electron multiplying unit 9. A plurality of slit-shaped openings 13*a* is formed in the focusing electrode plate 13. Each of the openings 13*a* is oriented in a common direction. Similarly, a plurality of slit-shaped electron multiplying holes 14 are aligned in each dynode 8 of the electron multiplying unit 9 for multiplying electrons.

By arranging the electron multiplying holes 14 in each dynode 8, electron multiplying paths L are formed through the layers of dynodes 8. Each path L corresponds one-on-one with each opening 13*a* formed in the focusing electrode plate 13, thereby forming a plurality of channels in the electron multiplying unit 9. In addition, the anodes 12 are configured in an 8-by-8 arrangement on the electron multiplying unit 9 so that each anode 12 corresponds to a prescribed number of channels. Since each anode 12 is connected to one of the stem pins 10, an individual output can be extracted via each stem pins 10.

Hence, the electron multiplying unit 9 is configured of a plurality of linear channels. A prescribed voltage is supplied to the electron multiplying section 9 and anodes 12 by connecting a prescribed stem pin 10 to a bleeder circuit, not shown. The photocathode 3*a* and focusing electrode plate 13 are set to the same potential, while each of the dynodes 8 and the corresponding anodes 12 are set to potentials increasing in order from the top layer. Accordingly, incident light on the faceplate 3 is converted to electrons by the photocathode 3*a*. The electrons are introduced into a prescribed channel by virtue of an electron lens effect generated by the focusing electrode plate 13 and the first dynode 8 stacked on the top layer of the electron multiplying unit 9. The electrons introduced into the channel are multiplied through each layer of the dynodes 8 while passing through the electron multiplying paths L. The electrons impinge on the anodes 12, enabling an individual output to be extracted from each anode 12 for each prescribed channel.

Figure 3:
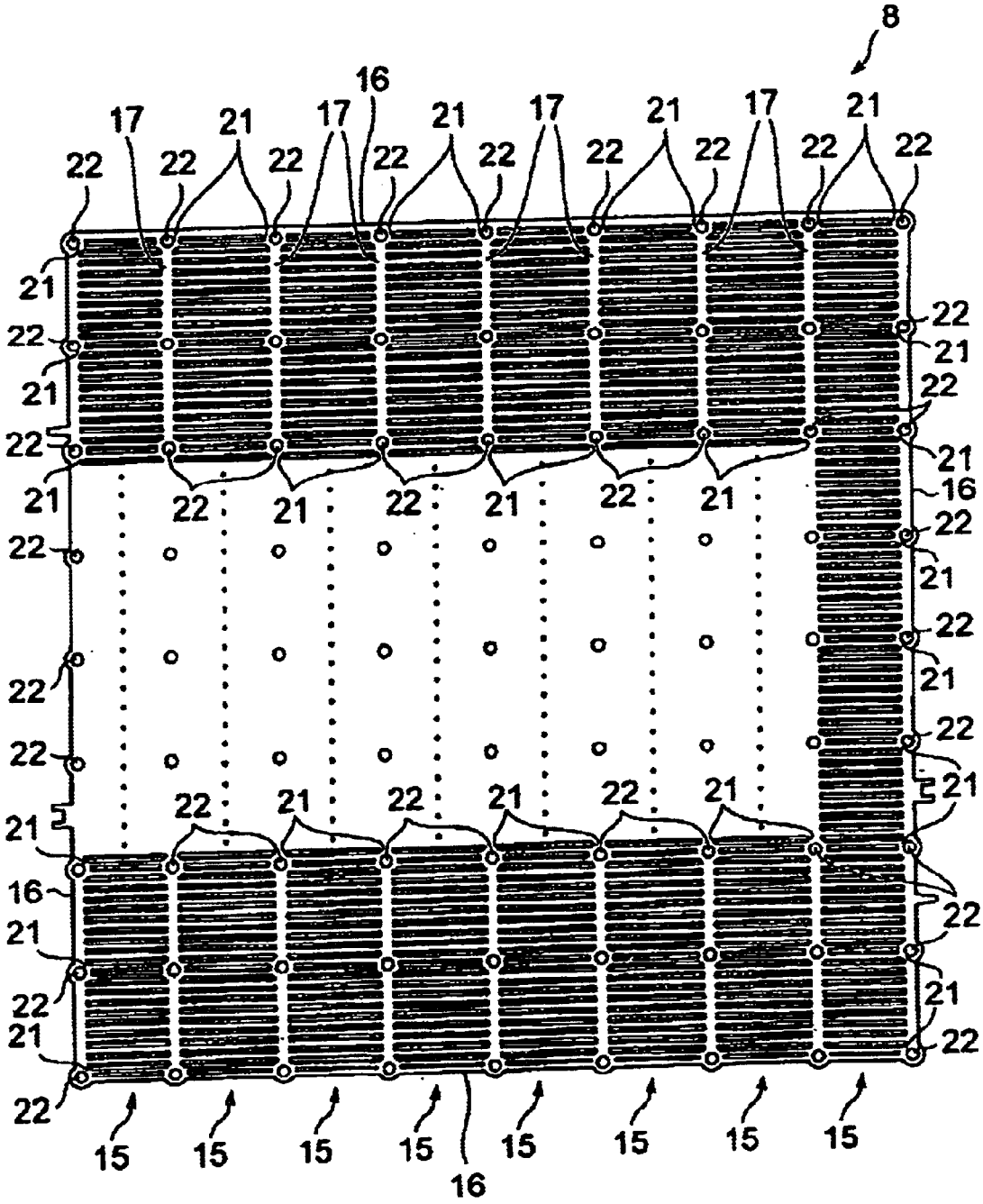
FIG. 3 is a plan view showing a dynode incorporated in the photomultiplier according to the preferred embodiment of the present invention.
Figure 4:
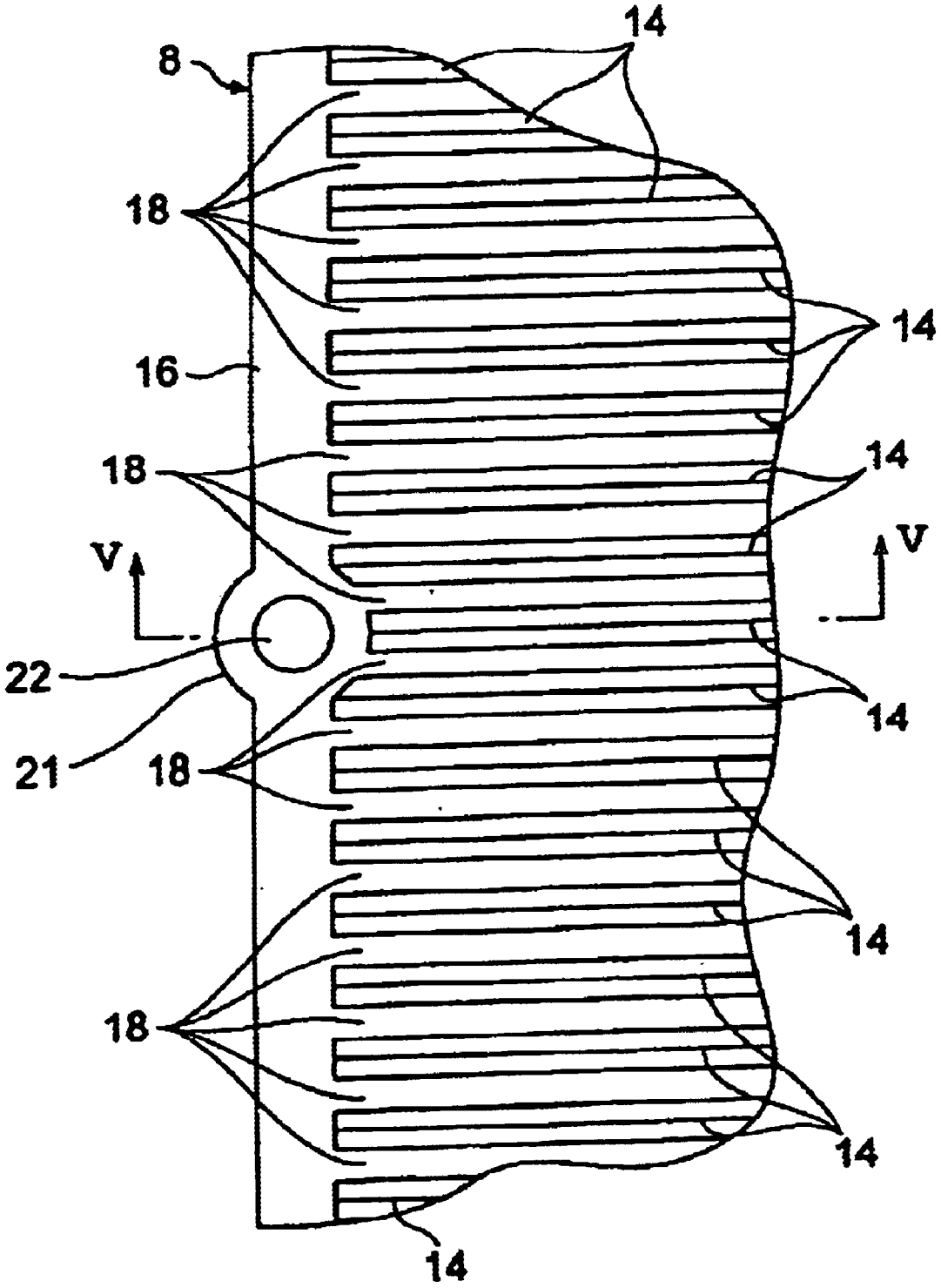
FIG. 4 is an enlarged plan view showing part of the dynode in FIG. 3.
Figure 5:
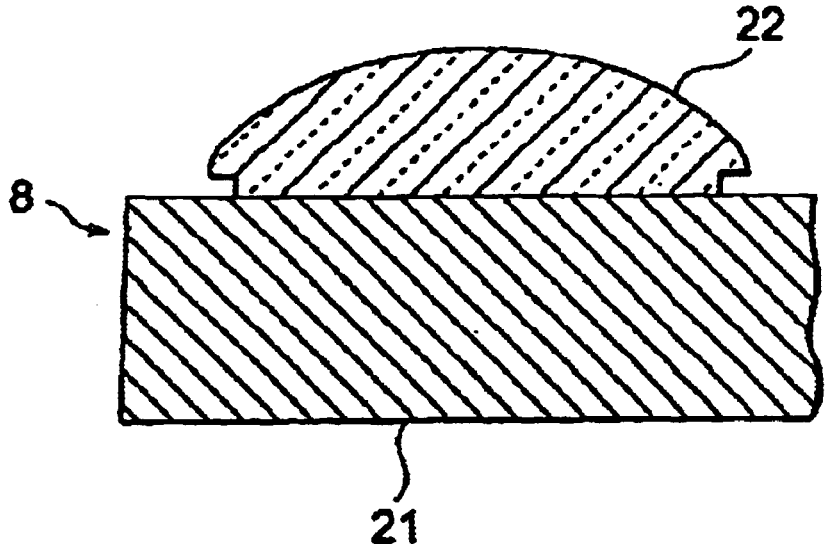
FIG. 5 is a cross-sectional view taken along the line V—V indicated in FIG. 4.

Next, the construction of the above dynodes 8 will be described in more detail with reference to FIGS. 3 and 5. FIG. 3 is a plan view showing the dynode 8. FIG. 4 is an enlarged plan view showing part of the dynode 8 in FIG. 3. FIG. 5 is a cross-sectional view taken along the line V—V indicated in FIG. 4.

Eight rows of channels 15 are formed in each dynode 8. The channels 15 are defined by outer frame sides 16 and partitioning parts 17 of the dynodes 8. A plurality of the electron multiplying holes 14 of equivalent number to the openings 13*a* of the focusing electrode plate 13 is arranged in the channels 15. All of the electron multiplying holes 14 have the same orientation and are arranged in a direction perpendicular to the paper surface. Linear multiplying hole boundary parts 18 serve to partition neighboring electron multiplying holes 14. The width of the partitioning parts 17 corresponds to the gap between neighboring anodes 12 and is wider than the multiplying hole boundary parts 18.

Glass receiving parts 21 formed with a greater width than the outer frame sides 16 and partitioning parts 17 are integrally provided with the dynodes 8 at prescribed positions on the outer frame sides 16 and partitioning parts 17. Nine of the glass receiving parts 21 are disposed on a single outer frame side 16 or partitioning part 17, totaling 81 glass receiving parts 21. Glass parts 22 are bonded to each of the glass receiving parts 21. The glass parts 22 are bonded by applying glass to the glass receiving parts 21 and hardening the glass. Each glass part 22 has a substantially hemispherical dome-like shape protruding upward. After bonding the dome-shaped glass parts 22 to the glass receiving parts 21, the dynodes 8 are stacked together. Accordingly, the electron multiplying unit 9 is formed by stacking each of the dynodes 8 interposed with the glass parts 22.

As described above, the glass receiving parts 21 are disposed at prescribed positions on the outer frame sides 16 and partitioning parts 17 of each dynodes 8. Each glass part 22 formed in a dome shape is bonded to each glass receiving part 21. The dynodes 8 are stacked together interposed by the glass parts 22. Accordingly, the glass parts 22 are bonded to a portion of the dynodes 8, thereby decreasing the surface area of the bonds between the dynodes 8 and glass parts 22. As a result, it is possible to suppress warping in the dynodes 8 and facilitate stacking of the same.

In order to manufacture (activate) the photocathode 3*a* and the dynodes 8, it is necessary to react antimony with alkali metal by introducing the alkali metal (vapor) into the vessel 5 and raising the temperature. When bonding glass closely to the entire surface on one side of the dynodes 8, the glass reacts with the alkali metal, reducing the electrical resistance of the glass surface. The reduced resistance causes a large leakage current to flow between neighboring dynodes 8 and between the dynodes 8 and the anodes 12. The output current of the photomultiplier 1 is monitored during activation of the photocathode 3*a* and the dynodes 8 in order to introduce alkali metal (vapor) until the sensitivity in the photocathode 3*a* and dynodes 8 reaches a prescribed value. However, it is not possible to monitor the output current when the leakage current described above is generated. By reducing the surface area of the bonds between the dynodes 8 and the glass parts 22 and forming point contacts between the stacked dynodes 8 and the glass parts 22, it is possible to suppress the generation of the leakage current described above, enabling the output current to be monitored in order to activate the photocathode 3*a* and the dynodes 8 appropriately.

When providing the glass receiving parts 21 on which the glass parts 22 are bonded, the surface area of the portion in which the electron multiplying holes 14 are arranged (channels 15) is reduced. However, as described above, the glass receiving parts 21 provided on parts of the outer frame sides 16 and partitioning parts 17 are formed wider than the outer frame sides 16 and partitioning parts 17, thereby making it possible to minimize decreases in surface area at the parts in which the electron multiplying holes 14 are arranged (channels 15), that is, the effective surface area for receiving light in the electron multiplying unit 9 (photomultiplier 1).

By forming wide glass receiving parts 21, it is possible to set a greater height for the glass parts 22 bonded to the glass receiving parts 21. Accordingly, a gap can be formed between the stacked dynodes 8 to facilitate bonding operations, such as the application of the glass parts 22 to the glass receiving parts.

Hydrofluoric acid or the like is used to melt the surface of the glass parts 22 to form a rough surface condition. Creapage discharge in the glass parts 22 is generated when discharge originating at borders (or triple junction of) between the glass receiving parts 21 (dynodes 8), the glass parts 22, and the vacuum space in the vessel 5 is transferred to the top dynode 8 via the surface of the glass parts 22. Accordingly, roughening the surface of the glass parts 22 as described above increases the creepage distance on the glass parts 22. Thus, it is possible to suppress the discharge between the dynodes 8 via the glass parts 22 and reduce the occurrence of noise caused by such discharge.

When using hydrofluoric acid or the like to melt the surface of the glass parts 22, the cross-section of the glass parts 22 is formed in a mushroom shape, as shown in FIG. 5 because the peripheral edge of the glass parts 22 is formed in an acute angle and melts more readily than the other parts of the glass parts 22. Hence, the surface area of the bond between the glass parts 22 and glass receiving parts 21 (dynodes 8) becomes smaller than the area of the glass parts 22 projected onto the glass receiving parts 21. Accordingly, the strength of the electric field between the dynodes 8 and particularly around the bordering portion (triple junction) of the glass receiving parts 21 (dynodes 8), glass parts 22, and vacuum space in the vessel 5 decreases, thereby increasing the breakdown voltage. As a result, the present invention can suppress the generation of discharge between the dynodes 8 via the glass parts 22 even more and can reliably reduce the occurrence of noise caused by such discharge.

Figure 6:
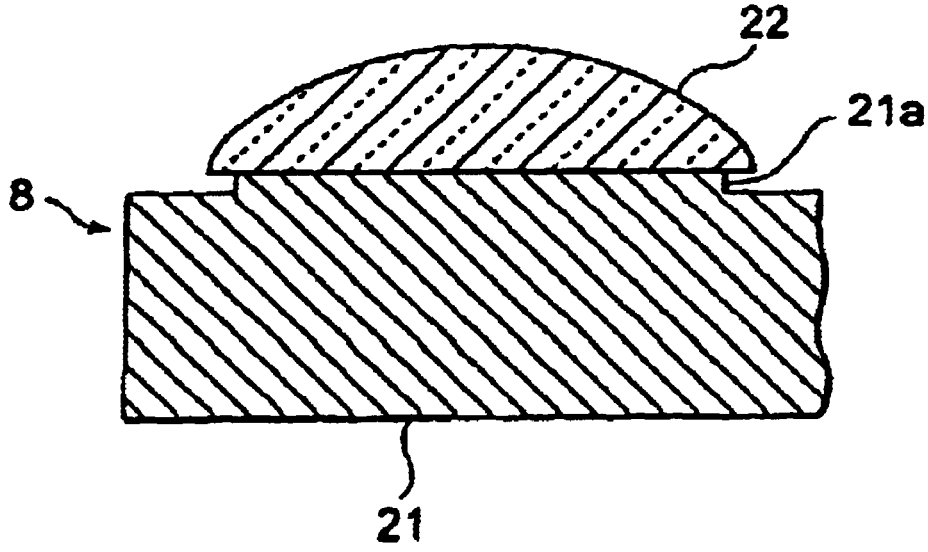
FIG. 6 is a cross-sectional view showing a dynode according to another embodiment.

Since the surface area of the bonds between the glass parts 22 and glass receiving parts 21 (dynodes 8) becomes smaller than the area of the glass parts 22 projected onto the glass receiving parts 21, it is possible to employ a method of melting the surface of the dynodes 8 rather than the method for melting the glass parts 22 described above. When employing a method for melting the surface of the dynodes 8, a step part 21*a* is formed in the glass receiving parts 21 (dynodes 8) on which the glass parts 22 are bonded, as shown in FIG. 6. The surface area of the bonds between the glass parts 22 and the step part 21*a* of the glass receiving parts 21 (dynodes 8) is smaller than the area of the glass parts 22 projected onto the glass receiving parts 21.

Figure 7:
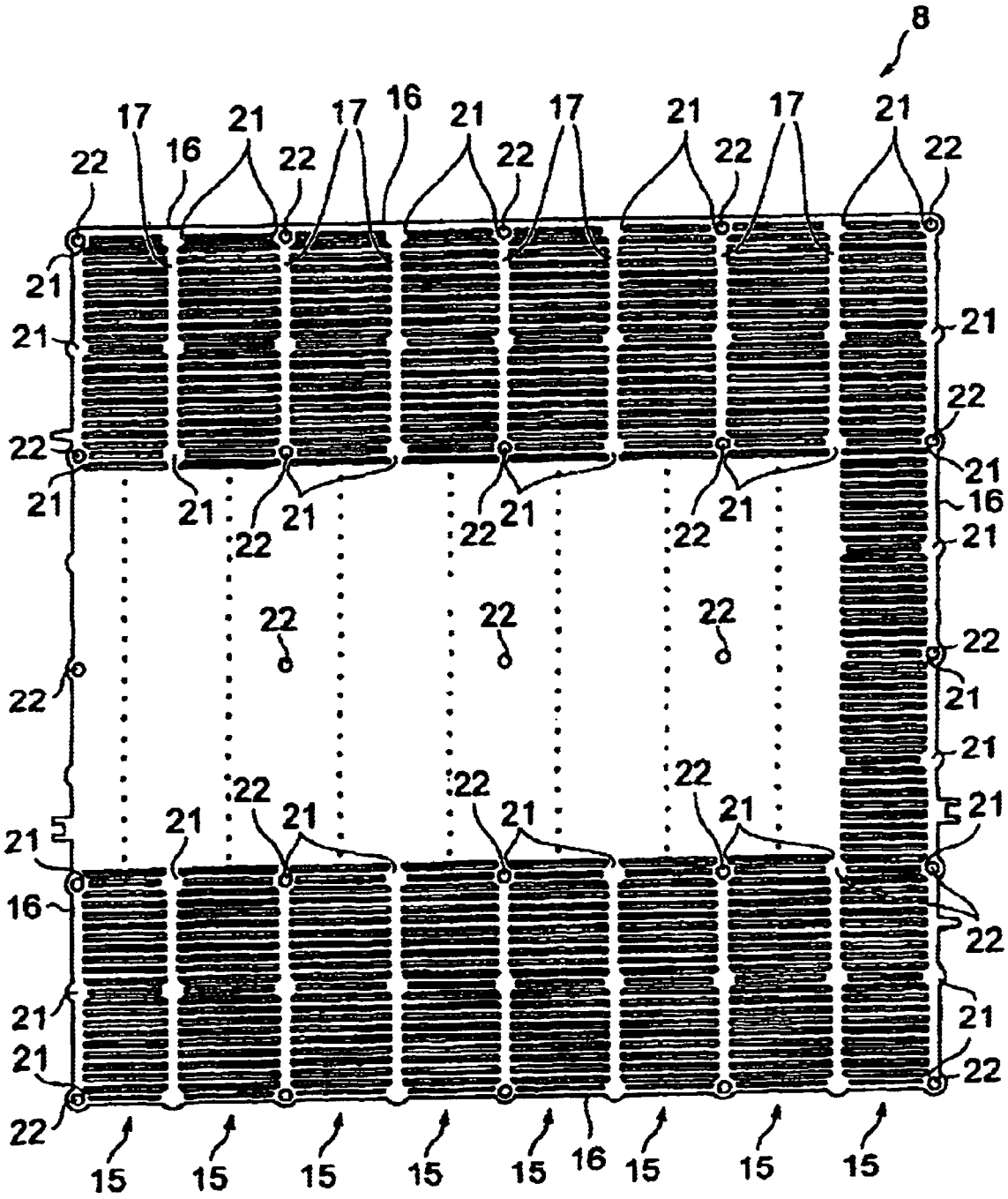
FIG. 7 is a plan view showing a dynode according to still another embodiment.

As another example of the dynodes 8, it is possible to configure the dynodes 8 such that the glass parts 22 are bonded to only some of the glass receiving parts 21, as shown in FIG. 7. In this case, twenty-five glass parts 22 are provided. By bonding the glass parts 22 to only some of the glass receiving parts 21 in this way, it is possible to further decrease the surface area of the bonds between the dynodes 8 and glass parts 22 and thereby more reliably suppress warping in the dynodes 8. Since this further controls the occurrence of a leakage current described above, it is possible to monitor the output current, enabling a more appropriate activation of the photocathode 3*a* and the dynodes 8.

Figure 8:
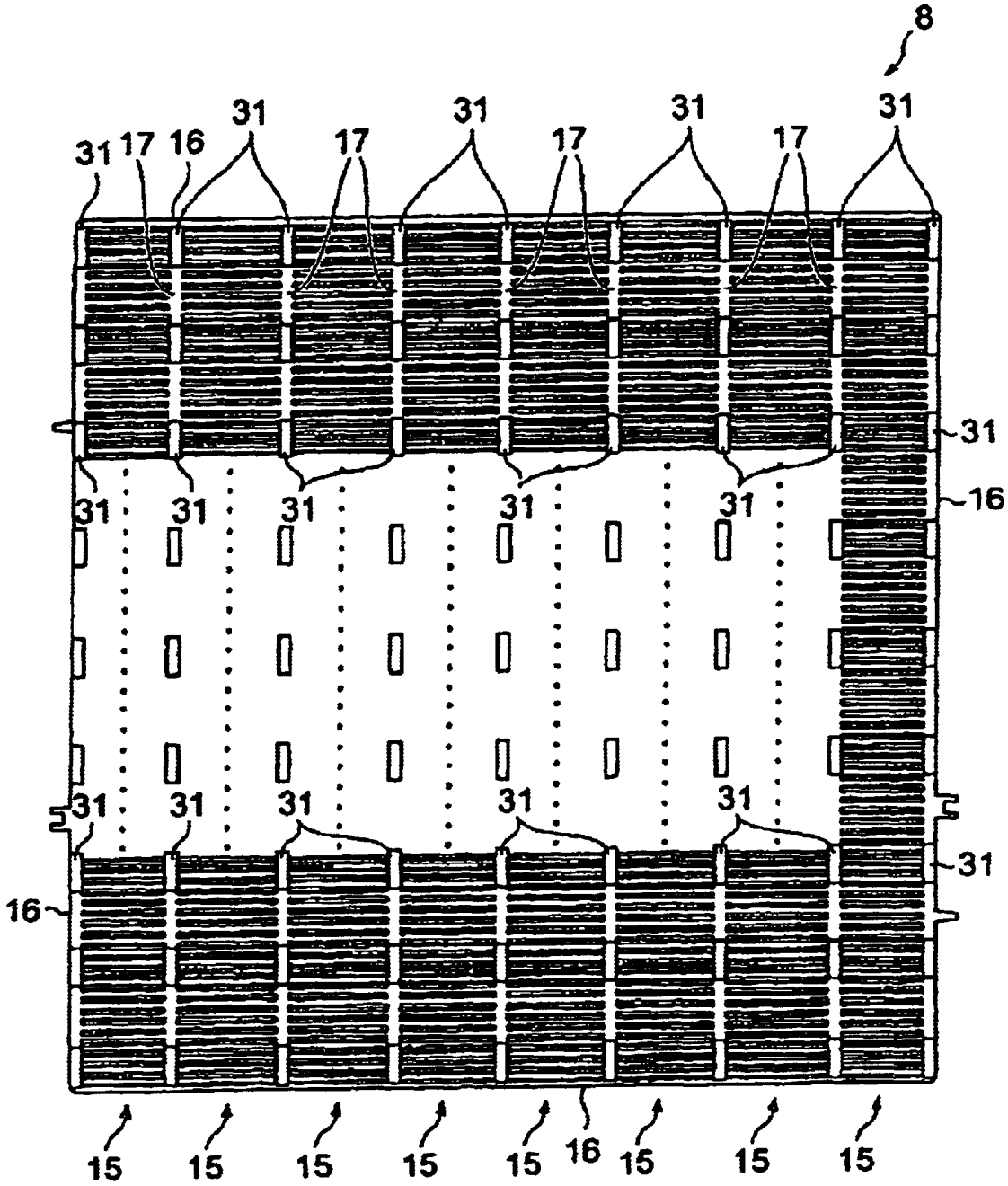
FIG. 8 is a plan view showing a dynode according to another embodiment.

Instead of providing the glass receiving parts 21 on the outer frame sides 16 and partitioning parts 17, glass parts 31 having a dome shape can be bonded at prescribed positions on the outer frame sides 16 and partitioning parts 17, as shown in FIG. 8. In this case, nine of the glass parts 31 are provided on each outer frame side 16 or partitioning part 17, making a total of 81 glass parts 31. The glass parts 31 are substantially Quonset-shaped, as a right circular cylinder divided in half by a plane passing through its axis of symmetry. In this way, the stacked dynodes 8 form approximate line contacts with the glass parts 22. Accordingly, by providing the Quonset-shaped glass parts 31 at prescribed positions on the outer frame sides 16 and partitioning parts 17, it is possible to bond the glass parts 31 to the dynodes 8 while suppressing a reduction in the surface area of regions in which the electron multiplying holes 14 are formed (channels 15), that is, the effective surface area for receiving light in the electron multiplying unit 9 (photomultiplier 1).

Figure 9:
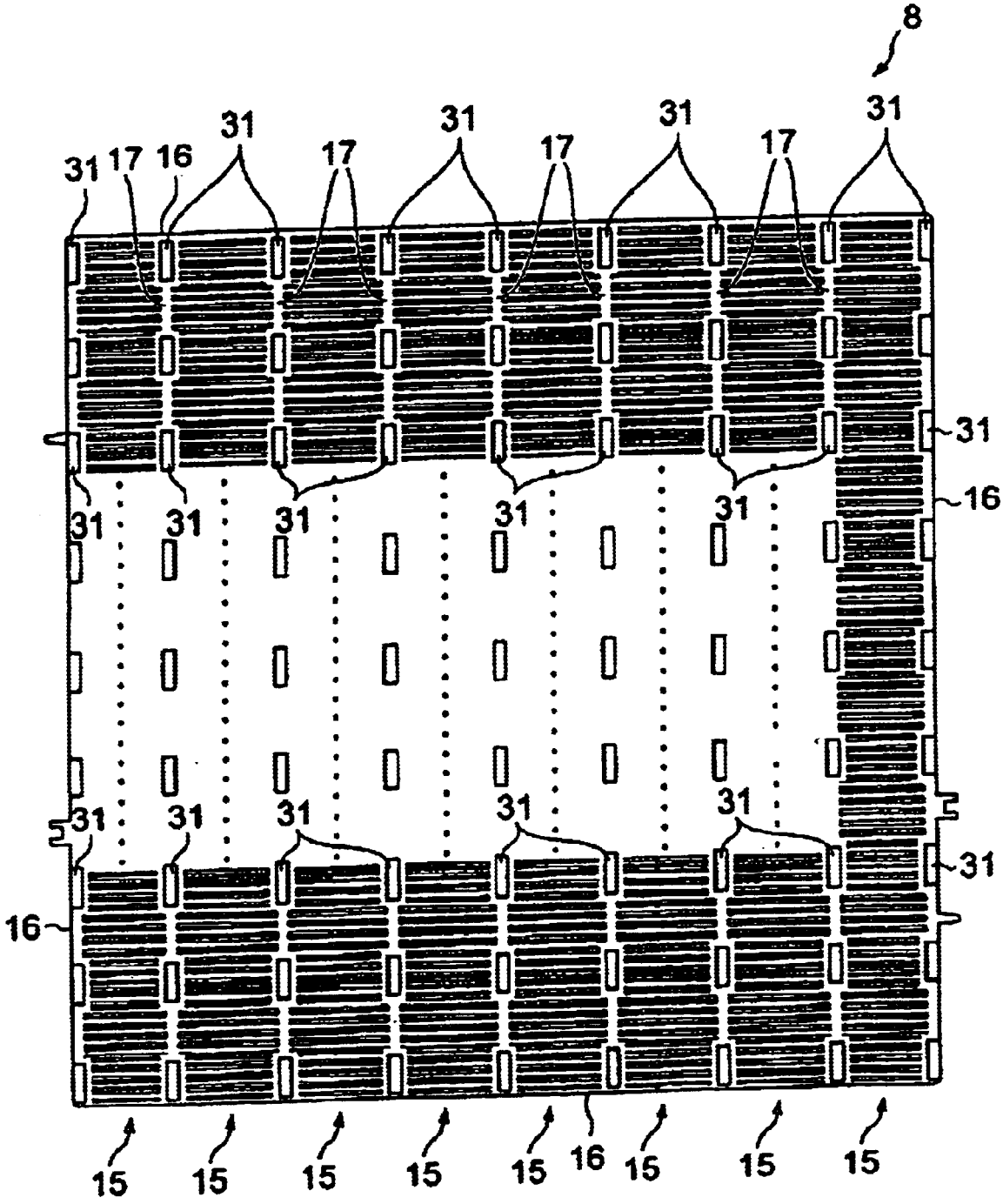
FIG. 9 is a plan view showing a dynode according to yet another embodiment.

The bottom surfaces of the glass parts 31 shown in FIG. 8 are rectangular and have a width approximately equivalent to the widths of the outer frame sides 16 and partitioning parts 17. However, it is also possible to form the glass parts 31 with bottom surfaces having a width slightly larger than the widths of the outer frame sides 16 and partitioning parts 17, as shown in FIG. 9. In this case, wide glass receiving parts 21 are formed on the outer frame sides 16 and partitioning parts 17.

Figure 10:
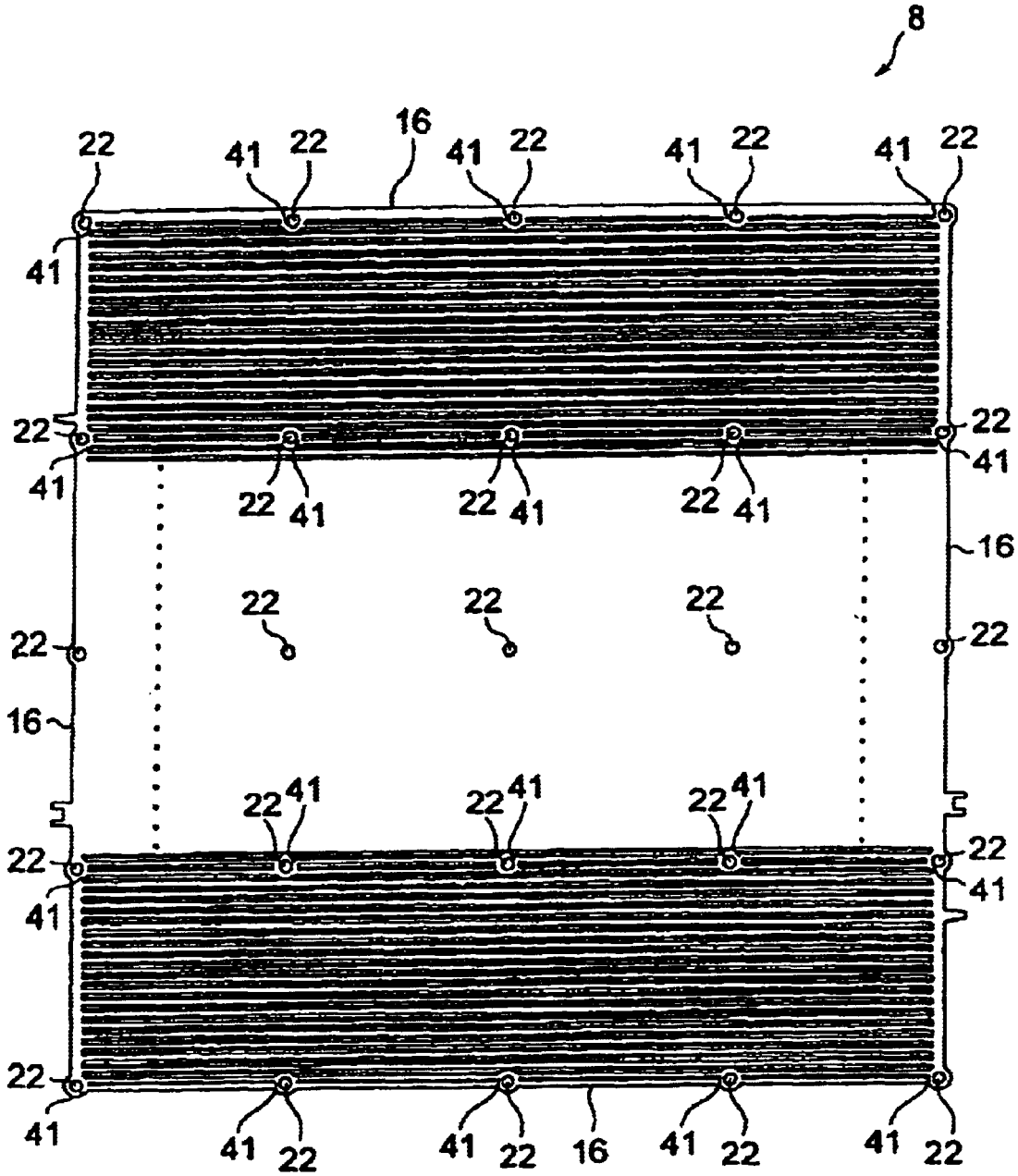
FIG. 10 is a plan view showing a dynode according to yet another embodiment.
Figure 11:
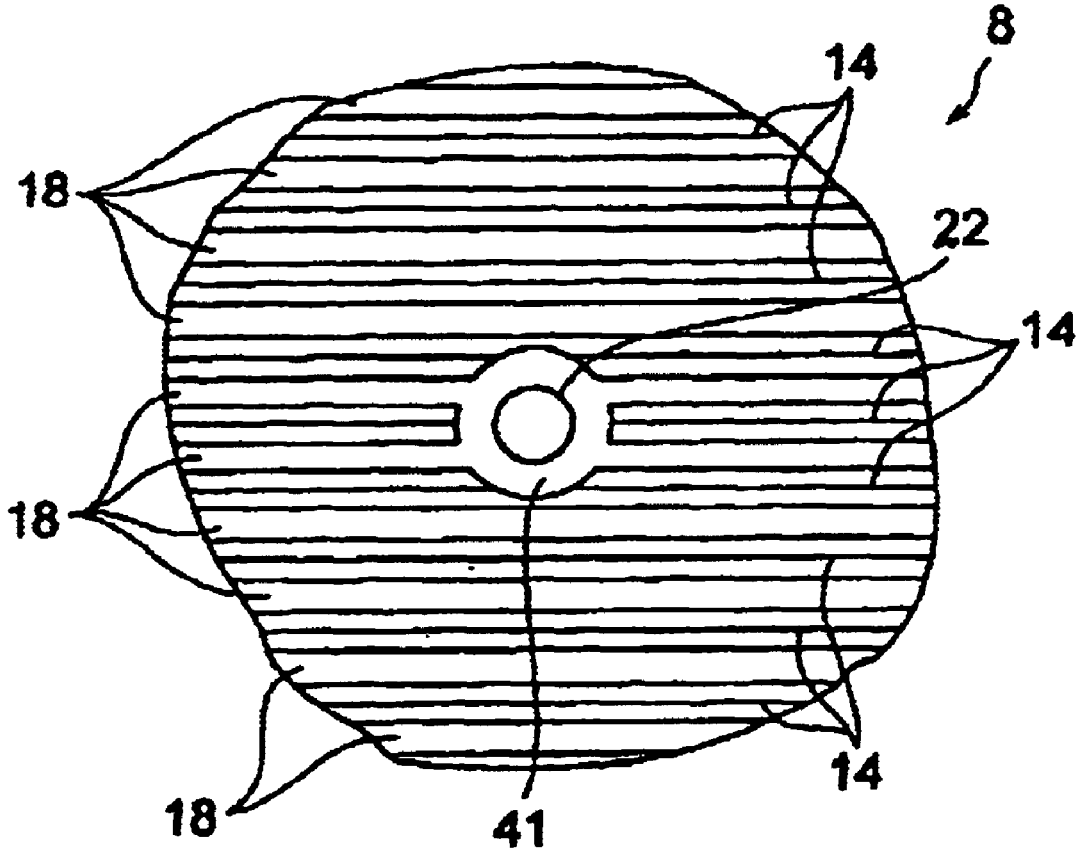
FIG. 11 is an enlarged plan view showing part of the dynode in FIG. 10.

Further, the present invention can be applied to an electron multiplying part (photomultiplier) having dynodes without the partitioning parts 17. As shown in FIGS. 10 and. 11, the dynodes 8 have the outer frame sides 16. A plurality of slit-shaped electron multiplying holes 14 having the same number as the openings 13*a* are formed in the dynodes 8. All of the electron multiplying holes 14 are oriented in the same direction and span between opposing outer frame sides 16. Glass receiving parts 41 having a larger width than the outer frame sides 16 are provided integrally with the dynodes 8 at prescribed positions on parts in which the outer frame sides 16 of each dynode 8 and the electron multiplying holes 14 are arranged. In this embodiment, there are twenty-five glass receiving parts 41. The glass parts 22 are bonded to all of the glass receiving parts 41.

By providing the glass receiving parts 41 on which the glass parts 22 are bonded, the surface areas of areas in which the electron multiplying holes 14 are formed is decreased. However, by providing the glass receiving parts 41 on a portion of the parts on which the outer frame sides 16 and electron multiplying holes 14 are arranged, as described above, it is possible to further suppress a decrease in surface area at areas in which the electron multiplying holes 14 are formed, that is, the effective surface area for receiving light in the electron multiplying unit 9 (photomultiplier 1).

The present invention is not limited to the preferred embodiments described above. For example, the glass parts 22 and glass parts 31 in the embodiments described are substantially hemispherical, like a dome, or substantially Quonset-shaped. However, the glass parts 22 and glass parts 31 can have any dome-like shape for forming either a point or line contact between the stacked dynodes and glass parts. It is not necessary to form the dome shape with strictly arcing outer contours. The top portion of the glass parts can be flat as well. Further, the glass receiving parts 21 and glass receiving parts 41 are provided on the outer frame sides 16, as described above, but it is not necessary to provide the glass receiving parts 21 or glass receiving parts 41 on the outer frame sides 16.

The present embodiments show a photomultiplier 1 including a photocathode 3*a*. However, it is obvious that the present invention can also be applied to an electron multiplier.

As described in detail, the present invention can provide an electron multiplier and photomultiplier capable of suppressing warping in the dynodes and facilitating stacking of the dynodes.

INDUSTRIAL APPLICABILITY

An electron multiplier and photomultiplier according to the present invention can be widely used in radiation detecting devices or other imaging devices for use in areas with low light intensity.

What is claimed is:

1. An electron multiplier, comprising:

an electron multiplying unit formed by stacking a plurality of dynodes, a plurality of electron multiplying holes being formed in each of the plurality of dynodes for multiplying electrons introduced therein, partitioning parts being provided on the each of the plurality of dynodes for partitioning the plurality of electron multiplying holes; and glass parts, each formed in a dome shape, have a base portion bonded to the partitioning parts, wherein the plurality of dynodes are stacked together with the glass parts interposed between adjacent dynodes wherein dome shaped portions of the glass parts are locally in abutment with the adjacent dynode without being bonded thereto.

2. The electron multiplier according to claim 1, wherein each of the partitioning parts has a predetermined width, glass receiving parts formed wider than the partitioning parts are provided on parts of the partitioning parts, and the glass parts are bonded to all of the glass receiving parts.

3. The electron multiplier according to claim 1, wherein each of the partitioning parts has a predetermined width, glass receiving parts formed wider than the partitioning parts are provided on parts of the partitioning parts, and the glass parts are bonded to selected ones of the glass receiving parts.

4. The electron multiplier according to claim 1, further comprising glass receiving parts provided on portions of the dynodes in which the plurality of electron multiplying holes are formed; and the glass parts are bonded to the glass receiving parts.

5. The electron multiplier according to claim 1, wherein the glass parts have a roughened surface.

6. The electron multiplier according to claim 1, wherein a bonded area of each of the glass parts to each of the plurality of dynodes is smaller than an area of each of the glass parts projected onto each of the plurality of dynodes.

7. An electron multiplier, comprising:

an electron multiplying unit formed by stacking a plurality of dynodes, a plurality of electron multiplying holes being formed in each of the plurality of dynodes for multiplying electrons introduced therein, partitioning parts being provided on the each of the plurality of dynodes for partitioning the plurality of electron multiplying holes; and a plurality of glass parts bonded to a first surface on one dynode of two adjacent dynodes in the plurality of dynodes, another dynode of the two adjacent dynodes being substantially in point contact with each of the plurality of glass parts.

8. An electron multiplier, comprising:

an electron multiplying unit formed by stacking a plurality of dynodes, a plurality of electron multiplying holes being formed in each of the plurality of dynodes for multiplying electrons introduced therein, partitioning parts being provided on the each of the plurality of dynodes for partitioning the plurality of electron multiplying holes; and a plurality of glass parts bonded to a first surface on one dynode of two adjacent dynodes in the plurality of dynodes, another dynode of the two adjacent dynodes being substantially in line contact with each of the plurality of glass parts.

9. A photomultiplier, comprising:

a photocathode; and an electron multiplier including:

an electron multiplying unit formed by stacking a plurality of dynodes, a plurality of electron multiplying holes being formed in each of the plurality of dynodes for multiplying electrons introduced therein, partitioning parts being provided on the each of the plurality of dynodes for partitioning the plurality of electron multiplying holes; and glass parts, each formed in a dome shape, the glass parts being bonded to the partitioning parts wherein the plurality of dynodes are stacked together with the glass parts interposed between adjacent dynodes.

10. The photomultiplier according to claim 9, wherein each of the partitioning parts has a predetermined width, glass receiving parts formed wider than the partitioning parts are provided on parts of the partitioning parts, and the glass parts are bonded to all of the glass receiving parts.

11. The photomultiplier according to claim 9, wherein each of the partitioning parts has a predetermined width, glass receiving parts formed wider than the partitioning parts are provided on parts of the partitioning parts, and the glass parts are bonded to selected ones of the glass receiving parts.

12. The photomultiplier according to claim 9, further comprising glass receiving parts provided on portions of the dynodes in which the plurality of electron multiplying holes are formed, and the glass parts are bonded to the glass receiving parts.

13. The photomultiplier according to claim 9, wherein the glass parts have a roughened surface.

14. The photomultiplier according to claim 9, wherein a bonded area of each of the glass parts to each of the plurality of dynodes is smaller than an area of each of the glass parts projected onto each of the plurality of dynodes.

15. A photomultiplier, comprising:

a photocathode; and an electron multiplier including:

an electron multiplying unit formed by stacking a plurality of dynodes, a plurality of electron multiplying holes being formed in each of the plurality of dynodes for multiplying electrons introduced therein, partitioning parts being provided on the each of the plurality of dynodes for partitioning the plurality of electron multiplying holes; and a plurality of glass parts bonded to a first surface on one dynode of two adjacent dynodes in the plurality of dynodes, another dynode of the two adjacent dynodes being substantially in point contact with each of the plurality of glass parts.

16. A photomultiplier, comprising:

a photocathode; and an electron multiplier including:

an electron multiplying unit formed by stacking a plurality of dynodes, a plurality of electron multiplying holes being formed in each of the plurality of dynodes for multiplying electrons introduced therein, partitioning tarts being provided on each of the plurality of dynodes for partitioning the plurality of electron multiplying holes; and a plurality of glass parts bonded to a first surface on one dynode of two adjacent dynodes in the plurality of dynodes, another dynode of the two adjacent dynodes being substantially in line contact with each of the plurality of glass parts.

* * * * *